US008800110B1

(12) United States Patent
Stephenson

(10) Patent No.: US 8,800,110 B1
(45) Date of Patent: Aug. 12, 2014

(54) GATE HINGE

(71) Applicant: Thomas R. Stephenson, Clinton, MO (US)

(72) Inventor: Thomas R. Stephenson, Clinton, MO (US)

( * ) Notice: Subject to any disclaimer, the term of this patent is extended or adjusted under 35 U.S.C. 154(b) by 0 days.

(21) Appl. No.: 13/918,806

(22) Filed: Jun. 14, 2013

Related U.S. Application Data

(60) Provisional application No. 61/689,872, filed on Jun. 14, 2012.

(51) Int. Cl.
*E05D 7/06* (2006.01)
*E05D 7/04* (2006.01)
*E05D 3/02* (2006.01)

(52) U.S. Cl.
CPC ..... *E05D 7/0423* (2013.01); *E05D 3/02* (2013.01)
USPC ..... 16/240; 16/245; 49/399; 256/73

(58) Field of Classification Search
CPC ..... E06B 11/02; E06B 11/04; E05D 7/0423; E05Y 2900/40; F16M 13/02
USPC ..... 16/238, 240, 245, 246, 253, 386; 256/19, 73; 49/381, 399; 248/218.4, 248/219.3
See application file for complete search history.

(56) References Cited

U.S. PATENT DOCUMENTS

| | | | | | |
|---|---|---|---|---|---|
| 211,657 | A | | 1/1879 | Herzog | 256/21 |
| 310,033 | A | | 12/1884 | Collamore | 16/246 |
| 375,038 | A | | 12/1887 | Wright | 16/246 |
| 375,039 | A | | 12/1887 | Wright | 16/246 |
| 504,451 | A | | 9/1893 | Lamb | 16/248 |
| 533,414 | A | | 1/1895 | Fagan | 49/386 |
| 710,051 | A | | 9/1902 | Fullam | 16/231 |
| 880,317 | A | | 2/1908 | Von De Martwitz | 16/246 |
| 1,015,676 | A | | 1/1912 | Graham | 49/242 |
| 1,019,184 | A | | 3/1912 | Peterson | 16/246 |
| 1,032,776 | A | | 7/1912 | Russell | 16/313 |
| 1,249,700 | A | | 12/1917 | Way | 16/246 |
| 2,607,278 | A | | 8/1952 | Hill | 403/261 |
| 3,107,390 | A | | 10/1963 | Shelton | 16/224 |
| 3,295,158 | A | | 1/1967 | Hotchkiss, Jr. et al. | 16/252 |
| 3,514,807 | A | | 6/1970 | Triplett | 16/253 |
| 4,793,098 | A | * | 12/1988 | Wilkerson | 49/55 |
| 5,042,198 | A | | 8/1991 | Privratsky | 49/248 |
| 5,282,336 | A | * | 2/1994 | Tucker | 49/21 |
| 6,073,396 | A | * | 6/2000 | Kietzmann | 49/381 |

(Continued)

FOREIGN PATENT DOCUMENTS

| | | | | |
|---|---|---|---|---|
| GB | 1591492 | A * | 6/1981 | |
| WO | WO9204520 | | 3/1992 | E05D 7/04 |

*Primary Examiner* — William Miller
(74) *Attorney, Agent, or Firm* — Jonathan A. Bay

(57) ABSTRACT

A gate-hinge bracket for fastening to a gate post has a J-bolt and a mounting plate. The J-bolt has an elongated threaded shank and a generally perpendicular pintle. The mounting plate has an internally-threaded socket for coupling with the threaded shank portion of the J-bolt. It further has a plurality of fastener openings for fastening it to the gate post by fasteners. Thus, the J-bolt can be twisted relative to the stationary mounting plate until the pintle portion is aligned on a chosen axis. Optionally there is a lock nut on the threaded shank between the pintle and the mounting plate in order to lock the pintle in a fixed position. Optionally the gate post is tree trunk or slice thereof bored with an enlarged clearance bore for the shank of the J-bolt, as well as with pilot holes for fasteners like lag screws.

6 Claims, 4 Drawing Sheets

(56) References Cited

U.S. PATENT DOCUMENTS

| | | | | |
|---|---|---|---|---|
| 6,241,216 | B1 * | 6/2001 | Holmberg | 256/32 |
| 6,725,504 | B1 | 4/2004 | Dickson et al. | 16/236 |
| 6,802,106 | B2 | 10/2004 | Taglianetti | 16/246 |
| 7,269,880 | B2 | 9/2007 | Wallis et al. | 16/237 |
| 2010/0077663 | A1 | 4/2010 | Singleton | |
| 2012/0036786 | A1 * | 2/2012 | Stull | 49/399 |

* cited by examiner 10
14
60
34
46
50
24
52
IV
IV
20, 22
24
12, 48
10

GATE HINGE

CROSS-REFERENCE TO PROVISIONAL APPLICATION(S)

This application claims the benefit of U.S. Provisional Application Ser. No. 61/689,872, filed Jun. 14, 2013.

BACKGROUND AND SUMMARY OF THE INVENTION

The invention relates to gate hinges and, more particularly, to a gate hinge having a screw for adjusting the hinged members relatively toward or away from one another.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
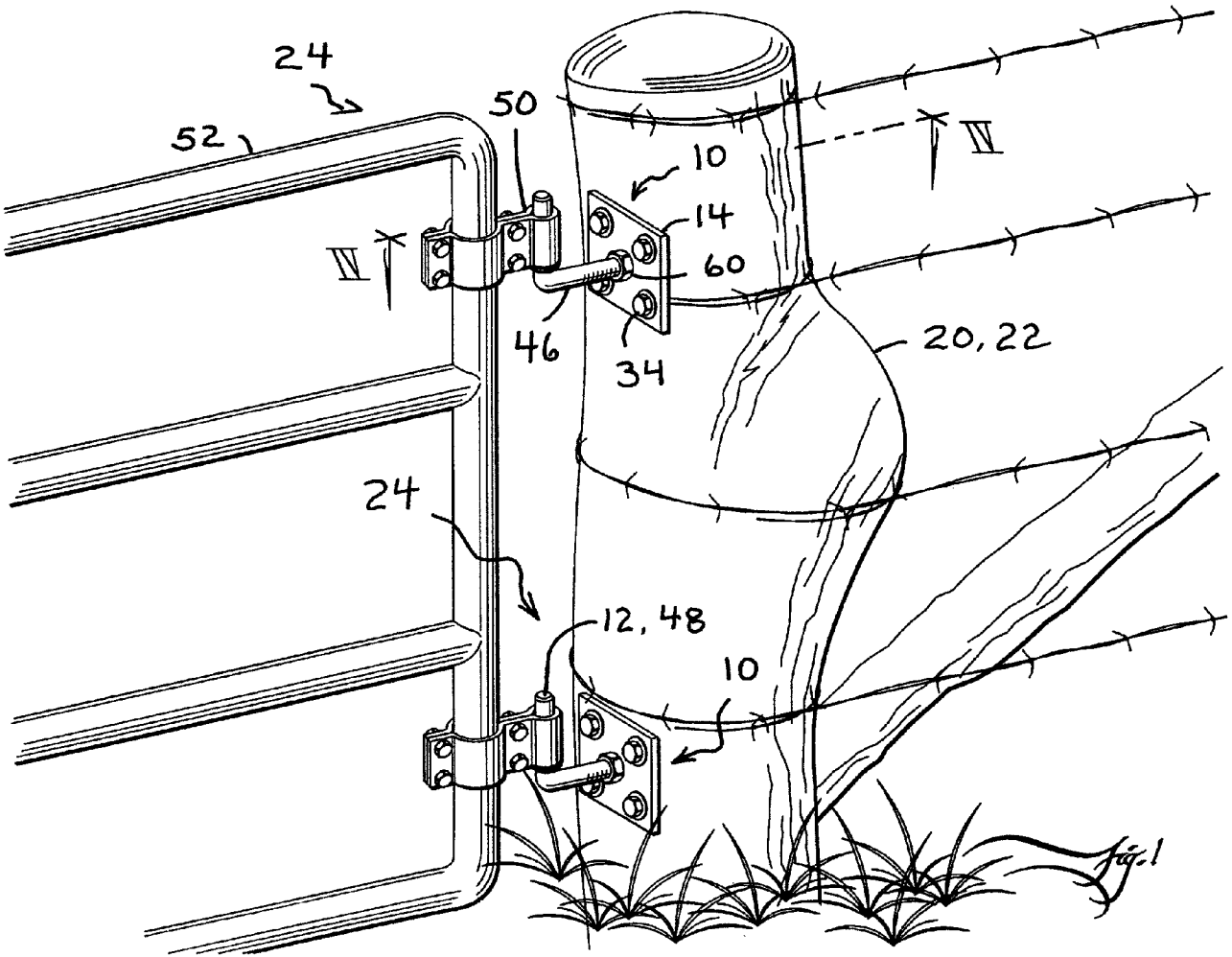
FIG. 1 is a perspective view of a pair of gate-hinge brackets in accordance with the invention, wherein the gate-hinge brackets are shown mounted to a slice (eg., a length or log) of a tree trunk serving as a gate post and for illustrative purposes only, as to demonstrate a preferred manner of forming a gate hinge.
Figure 2:
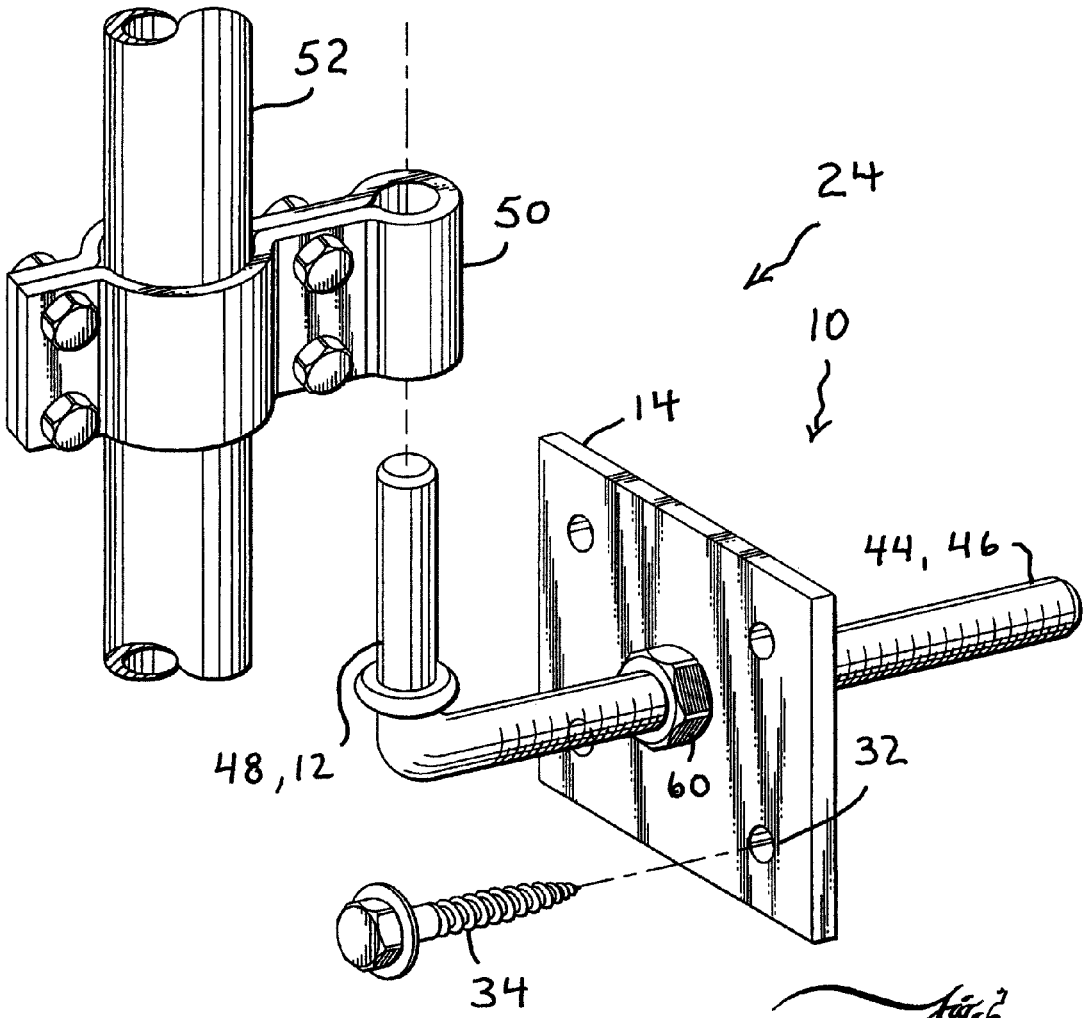
FIG. 2 is an enlarged scale perspective view of one gate-hinge bracket from FIG. 1 and relative to a gudgeon therefor (eg., a cylindrical receiver, or else, cylindrical sleeve attached to a gate or other suitable closure)
Figure 3:
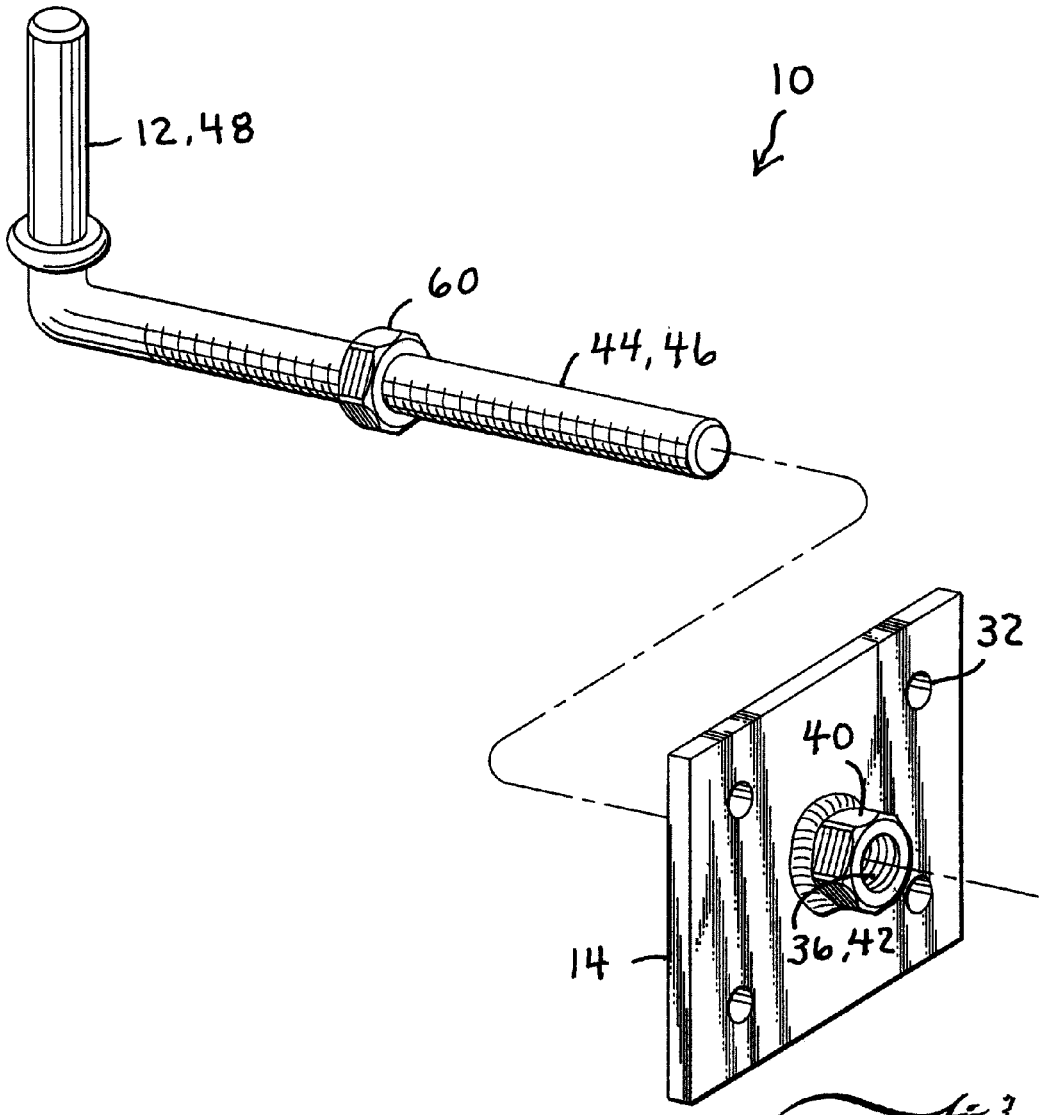
FIG. 3 is a perspective comparable to FIG. 2 except exploded and from the back-side of the main flange plate.

FIGS. 1 through 4 show a gate-hinge bracket 10 in accordance with the invention. The gate-hinge bracket 10 comprises a main J-bolt 12 and a main flange plate 14. It is an aspect of the invention that this bracket 10 is advantageously adapted to be mounted to a live tree trunk (or else, as is more particularly shown in FIG. 1, a slice 20 of a tree trunk 22 serving as a gate post therefor).

In the Midwest and Great Plains, it is a popular agricultural practice to grow hedgerows along field boundaries and the like. The preferred hedge plants are usually trees and not shrubs. One of the more popular trees is commonly known as the Osage Orange. But it is just as commonly known as Hedge Apple exactly because of its popular use in hedgerows. The main purpose for bothering with planting and maintaining hedgerows is believed to be more for the reason of providing a wind break than for the far-off future convenience of having a fence line. Indeed, many of these hedgerows were planted after and/or because of the Great Dust Bowl epoch of America's 1930's. Accordingly, many of these hedgerows are now quite mature.

In any event, numerous field and/or property boundaries have live trees studded in along the boundary. A trunk of a sturdy mature tree provides excellent service as a solid gate post. As mentioned above, it is an aspect of the invention that the gate-hinge bracket 10 in accordance with the invention is advantageously adapted to be mounted to a live tree trunk.

FIG. 1 shows a pair of gate-hinge brackets 10 mounted in a slice 20 of a tree trunk 22 for exhibiting a preferred manner of forming a gate hinge 24. The term 'slice' 20 refers to an axial length or log of a tree trunk 22. Preferably, the slice 22 of the tree trunk 22 might have a tangential surface 26 shaved out of its bark, about the width of the main flange plate 14 (see, eg., FIG. 4). That way, the tangential surface 26 would provide a relatively planar vertical surface for mounting the flange plate 14.

Accordingly, the main flange plate 14 is preferably but not exclusively a square piece of metal plate stock. A non-exclusive preferred size for the flange plate 14 comprises quarter-inch thick plate steel made into a five inch square tile, punched (or bored) with four ⅝ths inch diameter holes 32 for lag screws 34 proximate the corners thereof, and a main central aperture 36 having about a ⅞ths inch diameter for the J-bolt 12.

The main flange plate 14 has a bushing 40 firmly attached to the back of the flange plate 14. The bushing 40 has an internally-threaded socket 42 for the main J-bolt 12 to thread into. The preferred thread diameter is ¾ths an inch. One non-limiting example of such internally-threaded bushing 40 comprises without limitation a ¾ths inch nut welded to the flange plate 14.

With general reference to FIGS. 1 through 4, the J-bolt 12 comprises a horizontal shank portion 46 and a vertical pintle portion 48 (or sometimes otherwise referred to as a hinge-pin portion). The pin portion 48 comprises a smooth-walled cylinder. The shank portion 46 is formed with external thread 44. In use, the pintle 48 would be received in a gudgeon 50 (eg., cylindrical receiver, or else cylindrical sleeve) attached to a gate 52 (or other suitable closure). A gate hinge 24 is formed by at least two such gate-hinge brackets 10 in accordance with the invention, preferably with the pintles 40 thereof aligned on a common hinge axis. At least two pintles 40 can be mounted such that both point up, or pointed so that they oppose each other, or possibly pointed such that both point away from each other.

Figure 4:
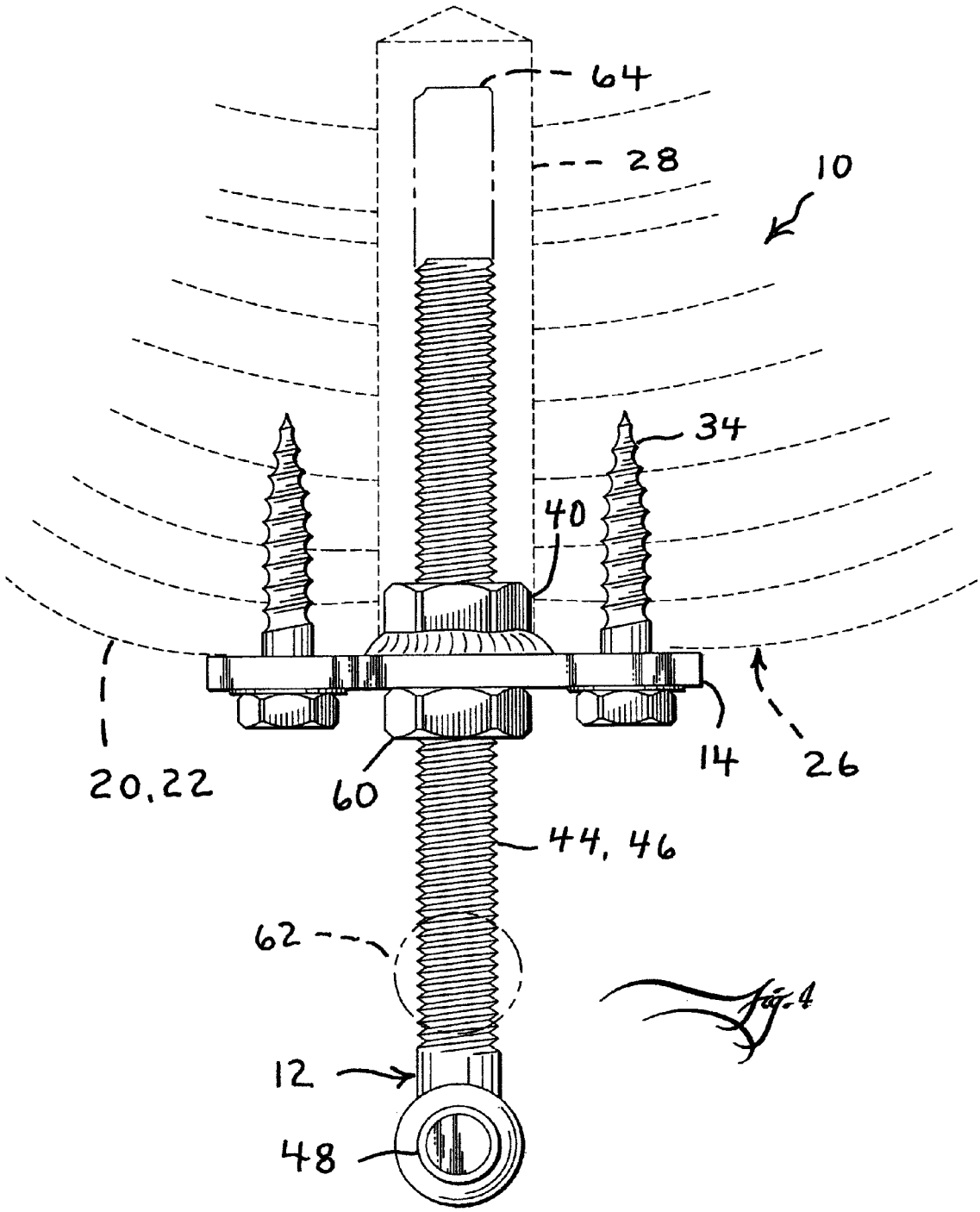
FIG. 4 is a top plan view taken in the direction of arrows IV-IV in FIG. 1.

FIGS. 1 and 4 show better how the preferred method of mounting the gate-hinge bracket 10 in accordance with the invention, and the results thereof. Preferably, a worker begins with forming a tangential surface 26 on a tree trunk 22 for providing a planar surface for mounting the flange plate 14 (see, eg., FIG. 4). This can be readily accomplished with a chain saw. Next, the worker drills into the tree trunk to provide a clearance bore 28 for the nesting of the J-bolt 12's threaded shank 44,46. The preferred diameter of the clearance bore is 1¼ inches to provide ample annular clearance around the J-bolt 12's threaded shank 44,46. FIG. 4 shows the bottom half of this clearance bore 28. Next, the flange plate 14 is held to the tangential surface 26, with the internally-threaded bushing 40 inserted into the clearance bore 28.

At this stage, the worker might drill four pilot holes for the lag screws 34. The lag screws 34 secure the flange plate 14 to the tree trunk 22.

Before the J-bolt 12 is screwed into the bushing 40 of the flange plate 14, the worker ensures that a lock nut 60 is spun onto the J-bolt 12's threaded shank 44,46 way up to nearly the pintle 48.

Then, the threaded shank 44,46 is twisted into the stationary bushing 40. The worker continues to twist and twist, sinking the threaded shank 44,46 into the bushing 40 deeper and deeper until the worker has the pintle aligned on the chosen axis 62 (ie., the final depth of the end of the threaded shank 44,46 is indicated by reference numeral 64 in FIG. 4). By these means, the worker can screw adjust the hinged members 22 and 52 relatively toward or away from one another (ie., the 'hinged members' being the gate 52 and the tree trunk 22).

Finally, the worker tightens the lock nut 60 against the front surface of the flange plate 14 to lock things in a tightly fixed position.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A gate-hinge bracket (10) adapted to be fastened to vertical gate post (20,22), comprising:

a J-bolt (12) having an elongated horizontal shank portion (46) formed with thread (44) and extending between an end (64) and a transition into a vertical pintle portion (48);

a flange plate (14) having a front side and a back side, and having a bushing portion (40) formed with an internally-threaded socket (42) for coupling with the threaded shank portion (44,46) of the J-bolt (12), and further being provided with a plurality of fastener openings (32);

a plurality of fasteners (34) for fastening the flange plate (14) to the gate post (20,22) by extension through the openings (32) therefor, whereby the back side of the flange plate (14) is against or facing the gate post (20, 22);

whereby the J-bolt (12) can be twisted and twisted relative to the stationary flange plate (14), sinking the threaded shank portion (44,46) further and further through the bushing (40) until the pintle portion (48) is aligned on a chosen axis (62); and a lock nut (60) for threading onto the threaded shank portion (44,46) of the J-bolt (12) between the pintle portion (48) and front side of the flange plate (14);

whereby the lock nut (60) is tightened on the threaded shank portion (44,46) until tight, either against or facing either one of the front side of the flange plate (14) or a front side of the bushing (40), and in order to hold the pintle portion (48) in a fixed position.

2. A combination of a gate-hinge bracket (10) and a tree trunk (22) or slice (20) thereof in service as a vertical gate post (20,22); said combination comprising:

the tree trunk (22) or slice (20) thereof providing service as the vertical gate post (20,22);

a J-bolt (12) having an elongated horizontal shank portion (46) formed with thread (44) and extending between an end (64) and a transition into a vertical pintle portion (48);

a flange plate (14) having a front side and a back side, and having a bushing portion (40) formed with an internally-threaded socket (42) for coupling with the threaded shank portion (44,46) of the J-bolt (12), and further being provided with a plurality of fastener openings (32);

a plurality of fasteners (34) for fastening the flange plate (14) to the tree trunk (22) or slice (20) thereof by extension through the openings (32) therefor, whereby the back side of the flange plate (14) is against or facing the tree trunk (22) or slice (20) thereof;

whereby the J-bolt (12) can be twisted and twisted relative to the stationary flange plate (12), sinking the threaded shank portion (44,46) further and further through the bushing (40) until the pintle portion (48) is aligned on a chosen axis (62);

wherein the tree trunk (22) or slice (20) thereof is formed with an elongated clearance bore (28) to provide clearance for the threaded shank portion (44,46) of the J-bolt (12); and a lock nut (60) for threading onto the threaded shank portion (44,46) of the J-bolt (12) between the pintle portion (48) and front side of the flange plate (14);

whereby the lock nut (60) is tightened on the threaded shank portion (44,46) until tight, either against or facing either one of the front side of the flange plate (14) or a front side of the bushing (40), and in order to hold the pintle portion (48) in a fixed position.

3. The combination of claim 2, wherein:

said tree trunk (22) or slice (20) is further formed with a tangential surface (26) shaved thereon to provide a relatively planar vertical surface for the mounting of the flange plate (14).

4. The combination of claim 2, wherein:

said tree trunk (22) comprises a living tree trunk.

5. The combination of claim 2, wherein:

said fasteners (34) comprise lag screws, and said tree trunk (22) or slice (20) is further formed with a pilot holes therefor.

6. A gate-hinge bracket adapted to be fastened to vertical gate post; comprising:

a J-bolt having an elongated shank portion formed with thread and a generally perpendicular pintle portion;

a mounting plate formed with an internally-threaded socket for coupling with the threaded shank portion of the J-bolt, said mounting plate further being provided with a plurality of fastener openings;

a plurality of fasteners for fastening the mounting plate to the gate post by extension through the openings therefor;

whereby the J-bolt can be twisted and twisted relative to the stationary mounting plate, sinking the threaded shank portion further and further through the internally-threaded socket therefor until the pintle portion is aligned on a chosen axis; and a lock nut for threading onto the threaded shank portion of the J-bolt between the pintle portion and the mounting plate;

whereby the lock nut is tightened on the threaded shank portion until tight against or tight relative to the mounting plate, and in order to hold the pintle portion in a fixed position.

* * * * *